United States Patent [19]

Dibowski et al.

[11] 4,168,807

[45] Sep. 25, 1979

[54] GRINDING ROLLER WITH OIL LEVEL CONTROL

[75] Inventors: Günter Dibowski, Essen; Helmut Grommes, Duisburg, both of Fed. Rep. of Germany

[73] Assignee: Deutsche Babcock Aktiengesellschaft, Oberhausen, Fed. Rep. of Germany

[21] Appl. No.: 937,599

[22] Filed: Aug. 28, 1978

[30] Foreign Application Priority Data

Sep. 22, 1977 [DE] Fed. Rep. of Germany ..... 2742678

[51] Int. Cl.[2] ..... B02C 15/14

[52] U.S. Cl. ..... 241/293; 241/117; 308/187

[58] Field of Search ..... 241/293, 296, 117, 111, 241/122; 308/187; 72/236

[56] References Cited

FOREIGN PATENT DOCUMENTS 2612390 9/1977 Fed. Rep. of Germany ..... 241/117

*Primary Examiner*—Richard B. Lazarus

*Attorney, Agent, or Firm*—Max Fogiel

[57] ABSTRACT

A grinding roller for roll crushing mills, in which the axle is retained in a roller amount provided with a barrier air connection. The axle, furthermore, carries a roller hub connected with a roller shell, over inner bearings lubricated by splash lubrication. A measuring sensor reaches into the oil sump and is led through a core bore in the axle. End faces of the axle are surrounded by covers placed on the roller hub and on the roller mount while leaving gaps. Bores connect the respective gaps with the core bore, and these bores pass from both facing ends through the axle. One of the bores extending out from the respective gap facing the interior of the mill, passes above the oil level and parallel to the oil surface. An extension pipe having a ventilating filter therein, is placed on the bore line on the side of the roller mount.

6 Claims, 1 Drawing Figure

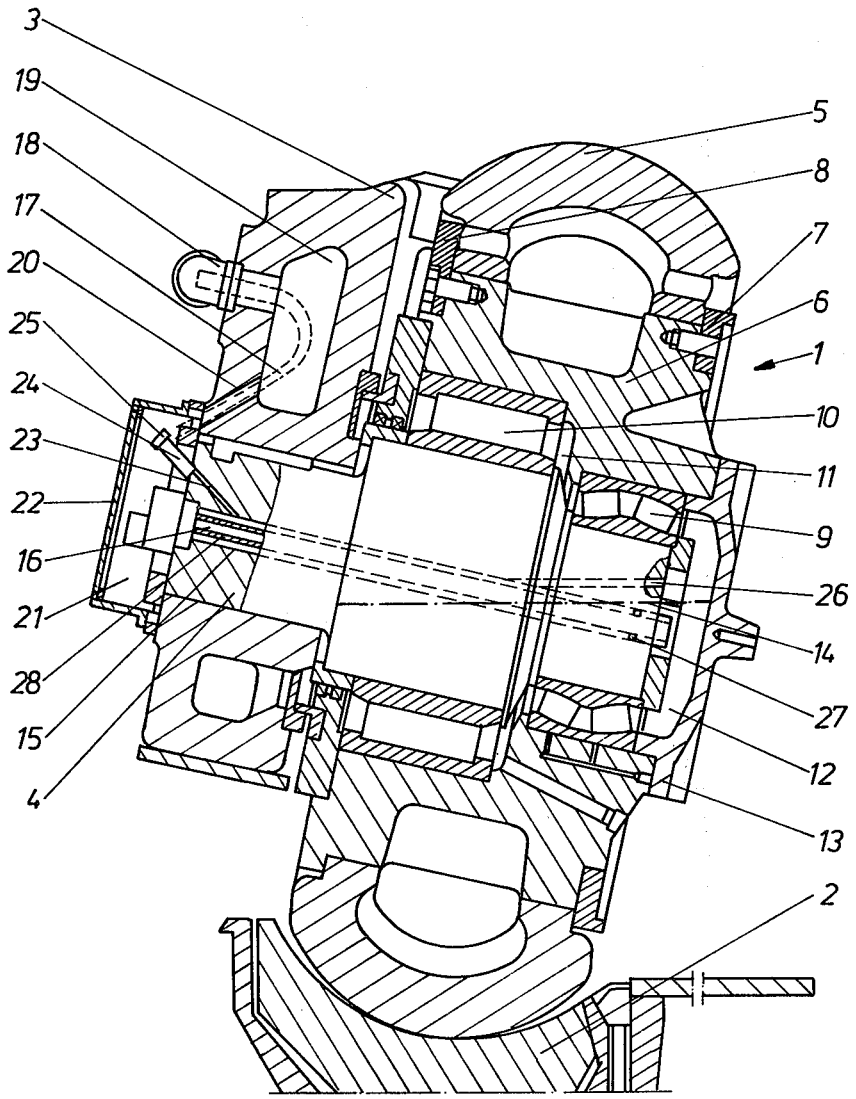
3
19
18
17
20
25
24
23
22
16
21
28
15
4
5
8
7
6
1
10
11
9
26
14
27
12
13
2

GRINDING ROLLER WITH OIL LEVEL CONTROL

BACKGROUND OF THE INVENTION

The present invention concerns a grinding carrier roller for roll crushing mills, whose axle is retained in a roller mount provided with a barrier air connection and over inner bearings lubricated by splash lubrication and carries a roller hub connected with a roller shell. A measuring sensor reaching into the oil sump is led through a core bore provided in the axle and the end faces of the axle are surrounded by a cover placed respectively on the roller hub and on the roller mount while leaving a gap.

In a known such grinding roller (German Laid-Open Document 2,326,470) the measuring sensor is used for the simultaneous measurement of the oil level and the oil temperature. It consists of a temperature measuring sensor (thermo-couple), the metal sleeve of which is electrically insulated against the bore in the axle. The metal sleeve and the bore form the oppositely lying surfaces of a capacitor, the capacitance of which is varied by the oil which penetrates into the space between the surfaces. The capacitance change is thus a measure of the height of the oil level.

This measuring sensor has proved itself in operation. However, under extreme conditions, for example on the starting up and operation of the mill, difficulties showed themselves in the determination of the oil level. These shall be avoided by the present invention.

Among other objects of the present invention are to provide an arrangement of the foregoing character which is substantially simple in construction and may be economically fabricated.

It is also an object of the present invention to provide an arrangement, as described, which may be readily maintained in service and which has a substantially long operating life.

SUMMARY OF THE INVENTION

The present invention is based on the task of further developing the measuring equipment in a grinding roller of the jinitially mentioned kind in such a manner that a checkable oil level is always present.

This problem is solved according to the invention in that a respective bore, which connects the respective gap with the core bore, is led from both facing ends through the axle.

The invention was used on the recognition that the measurement of the oil level can be falsified by non-unique airing and ventilation conditions of the interior space of the grinding roller standing under pressure. Thus, the case can arise that oil is urged out of the oil sump into the core bore through excess pressure on one side and too high an oil level is simulated. Through the arrangement of the bores according to the invention, clear pressure conditions are created in the core bore of the axle of the grinding roller so that a checkable oil level is present.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

A longitudinal section through a grinding roller of a roll crushing mill, in accordance with the present invention.

DESCRIPTION OF THE PREFERRED EMBODIMENTS

The roll crushing mill consists of two stationary grinding rollers 1, which roll along on an annular grinding plate 2. The grinding plate 2 rests on a (not shown) grinding plate carrier which is rotated through a gear and a motor. Each grinding roller 1 is retained in a roller mount 3 and inclined from the vertical at an angle of about 15°.

The roller mount 3 carries the axle 4, on which the grinding roller 1 is rotatably journalled. The grinding force is exerted on the grinding roller 1 by a guide frame which acts on the roller mount 3.

The grinding roller consists in detail of the roller shell 5 and the roller hub 6 produced of chilled cast iron. The roller shell 5 has a U-shaped profile and is pushed onto the seating surface of the roller hub 6. A securing ring 7, which is connected with the roller hub 6 and which bears against the flanks of the roller shell 5, serves for protection against axial displacement. A protection against rotation is effected in that fitting pieces 8 engage in corresponding recesses of the flanks of the roller shell 5.

The roller hub 6 is journalled through two roller or ball bearings 9 and 10 on the axle 4. In that case, the roller or ball bearing 9 is constructed as a fixed bearing and the roller or ball bearing 10 as a loose bearing. The bearings 9 and 10 are lubricated by splash lubrication. In that case, the oil is disposed in the space 11 formed between the roller hub 6 and the axle 4 and in the gap 12 between the roller hub 6 and the cover 13 closing it off from the interior of the mill. The oil level is indicated in the drawing by the line 14.

The axle 4 is provided in longitudinal direction with a core bore 15, through which a measuring sensor 16 is led up into the oil sump within the gap 12. The measuring sensor 16 can consist of a thermo-couple whose metal sleeve is electrically insulated from the core bore 15. The metal sleeve of the measuring sensor 16 and the core bore 15 form the oppositely lying surfaces of a capacitor, whose capacitance is varied by the oil penetrating into the space between these surfaces. The measuring conductors 17 connected to the measuring sensor 16 are led out externally of the mill so that remote monitoring is possible.

The roller mount 3 is provided with a barrier air connection 18, through which compressed air is conducted into the interior of the grinding roller 1. This compressed air gets from the barrier air connection 18 into an annular space 19 within the roller mount 3 and by way of a channel 20 into a barrier air space 21. This is provided at the rear end face of the shaft 4 and enclosed by a cover 22 placed on the roller hub 6. The barrier air space 21 stands in connection through the core bore 15 with the gap 12.

Through a ventilation bore 23, which is led from the rear end face of the axle 4 obliquely through the axle 4 into the core bore 15, this is additionally connected with the air barrier space 21. An extension pipe 24, in which a ventilating filter 25 is provided, is connected to the ventilation bore 23.

A further ventilation bore 26 is led through the axle 4 from the end face of the axle 4 facing the interior of the mill. This additional ventilation bore 26 runs above the oil level and parallel to the oil level 14 and connects the gap 12 with the core bore 15. The diameter of the additional ventilation bore 26 is somewhat smaller, for example by ¼, than the diameter of the core bore 15. Through the interplay of the ventilation bores 23 and 26, pressure balance prevails in the interior of the grinding roller 1. A falsification of the oil level is thus eliminated.

Within the core bore 15, the measuring sensor 16 is centered by a star 27 consisting of a heat-resistant insulating material. The measuring sensor 16 is likewise centered in the rear part of the axle 4 by means of a protective sleeve 28. The protectivesleeve 28 should be split in radial direction in the proximity of the head of the measuring sensor 16.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A grinding roller for roll crushing mills comprising: an axle; a roller mount retaining said axle and having a barrier air connection; inner bearings; a roller hub connected to a roller shell and mounted on said axle; oil sump means; said axle having a core bore; measuring sensor means extending into said oil sump means and passing through said core bore; said axle having end faces surrounded by covers on said roller hub and said roller mount leaving gaps; bores connecting said gaps to said core bore and passing from facing ends through said axle.

2. A grinding roller as defined in claim 1, wherein said inner bearings are splash-lubricated.

3. A grinding roller as defined in claim 1, wherein one of said bores connecting said gaps to said core bore extends out from a gap facing the interior of the mill and passes above the oil level and parallel to the oil surface.

4. A grinding roller as defined in claim 1, including an extension pipe having a ventilating filter therein and placed in one of said bores connecting said gaps to said core bore, said one bore lying on a side of said roller mount.

5. A grinding roller as defined in claim 3, including an extension pipe having a ventilating filter therein and placed on one of said bores connecting said gaps to said core bore, said one bore lying on a side of said roller mount.

6. A grinding roller as defined in claim 1, wherein said inner bearings are splash-lubricated, one of said bores connecting said gaps to said core bore extending out from a gap facing the interior of the mill and passing above the oil level and parallel to the oil surface, extension pipe means having ventilating filter means and placed on another one of said bores connecting said gaps to said core bore, said other bore lying on a side of said roller mount.

* * * * *